US005236089A

United States Patent [19]

Smitham et al.

[11] Patent Number: 5,236,089

[45] Date of Patent: Aug. 17, 1993

[54] METHOD OF BENEFICIATING COAL

[75] Inventors: James B. Smitham, Adamstown Heights; Ray Keast-Jones, Maryland; John F. Ellison, Barrack Heights; Keith R. S. Horrocks, Farmborough Heights, all of Australia

[73] Assignee: The Broken Hill Proprietary Company Limited, Melbourne, Australia

[21] Appl. No.: 827,320

[22] Filed: Jan. 29, 1992

[30] Foreign Application Priority Data

Jan. 30, 1991 [AU] Australia ..... PK 4365

[51] Int. Cl.[5] ..... B03B 13/00; B03B 5/54

[52] U.S. Cl. ..... 209/1; 44/621; 209/211; 209/172.5

[58] Field of Search ..... 209/1, 211, 172.5, 546; 210/512.1, 96.1; 44/621, 903

[56] References Cited

U.S. PATENT DOCUMENTS

| | | | |
|---|---|---|---|
| 3,687,284 | 8/1972 | Leeman et al. | 209/172.5 X |
| 4,028,228 | 6/1977 | Ferris et al. | 209/172.5 X |
| 4,276,119 | 6/1981 | Karnis et al. | 209/211 X |
| 4,470,901 | 9/1984 | Burgess | 209/1 |
| 4,775,464 | 10/1988 | Ferrara et al. | 209/172.5 X |
| 4,857,172 | 8/1989 | Pipkin et al. | 209/172.5 X |
| 5,082,892 | 6/1991 | Klima et al. | 44/621 |
| 5,153,838 | 10/1992 | Kindig | 209/172.5 X |

FOREIGN PATENT DOCUMENTS 554917 7/1983 Australia .

*Primary Examiner*—Donald T. Hajec

*Attorney, Agent, or Firm*—Nikaido, Marmelstein, Murray & Oram

[57] ABSTRACT

The separation density of a dense media comprising a slurry of magnetite and water in a cyclone for beneficiating coal containing refuse is maintained within predetermined limits by: (a) measuring the total solids in an overflow of the cyclone; (b) comparing the total solids with a predetermined correlation with separation density; and (c) changing the relative proportions of the feed flow of magnetite and water to the cyclone when the separation density as determined by the correlation is outside the predetermined limits.

6 Claims, 2 Drawing Sheets

METHOD OF BENEFICIATING COAL

Figure 1:
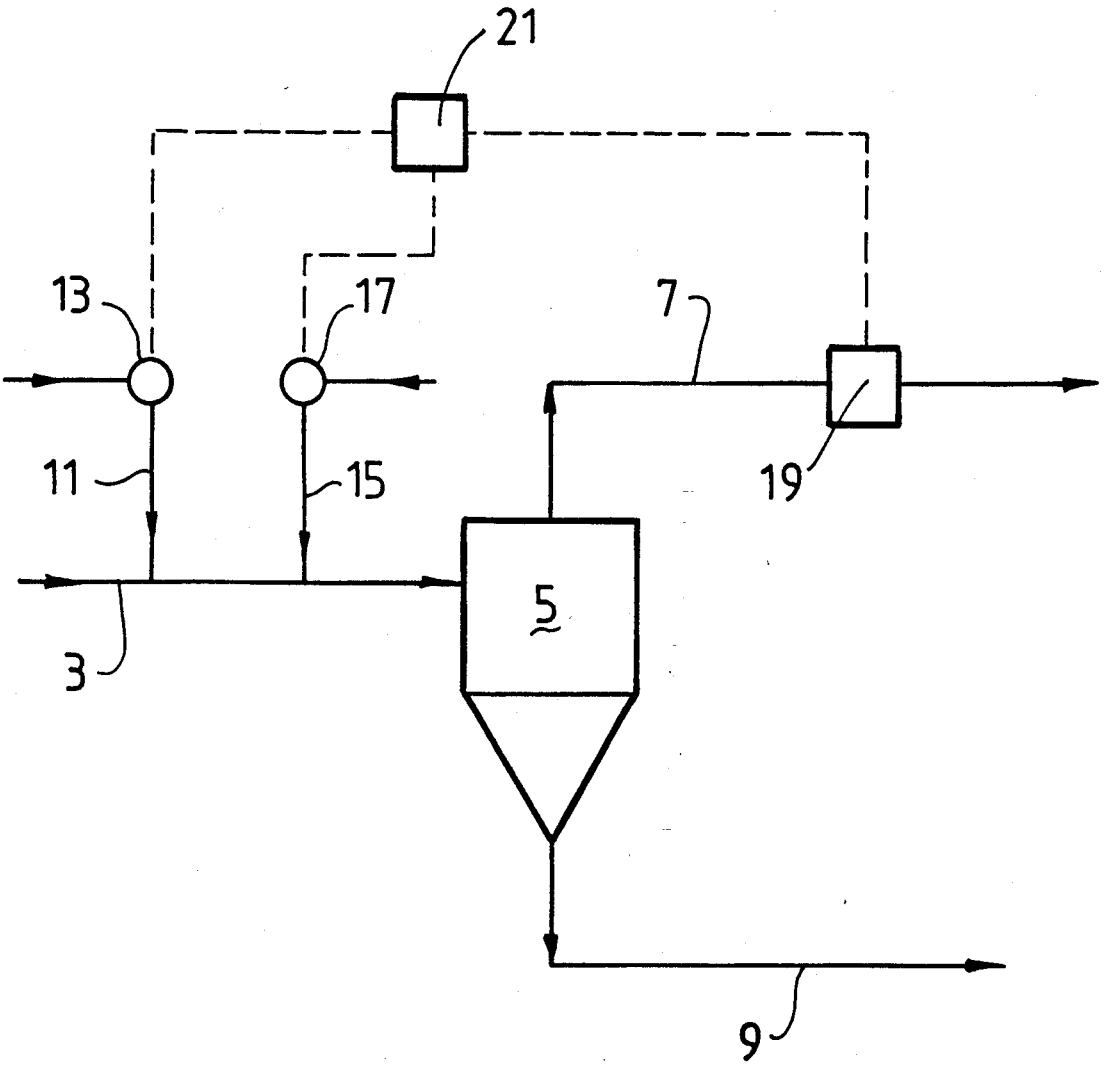

The present invention relates to a method of beneficiating material, such as coal, in a dense-medium cyclone circuit.

In terms of both the number of units installed and tonnes of coal treated, dense-medium cyclones are the pre-eminent benefication unit within the Australian coal industry. In a typical dense-medium cyclone, a dense media, such as a slurry of magnetite and water, is maintained in the cyclone and coal to be beneficiated, i.e. coal containing refuse material, is introduced into the cyclone. The dense media is selected to have a specific gravity greater than the coal so that the coal reports to the cyclone overflow and the refuse material which has a specific gravity greater than that of the dense media reports to the cyclone underflow.

The treatment capacity of individual dense-medium cyclone modules is usually relatively low (100–200 TPH) so that parallel circuits are necessary for the treatment of the large tonnages invariably required by industry economics. For maximum yield of beneficiated coal it is important that all parallel dense-medium cyclone circuits in a plant are operated at equal separation density.

The term "separation density" is herein understood to mean the density at which a particle has an equal chance of reporting to overflow or underflow or where 50% of the particles that have a density equal to the separation density report to the overflow and 50% to the underflow.

The separation density can be inferred from conventional float/sink or tracer tests, but these are usually only conducted at sporadic intervals. Furthermore, although the results of such tests relate to the circuit operation at the time of the tests, float/sink analysis is slow and expensive and density traces reflect the "spot" performance of the circuit rather than its long term operation. A number of operational and test procedures have been developed in an attempt to reduce inter-circuit differences in separation density. For example, it is common practice to operate all circuits at the same circulating medium specific gravity and maintain, as near as possible, equal cyclone feed pressures. However, variations in cyclone and pump wear rates and the long term unreliability of pressure sensors still lead to significant differences in separation density between circuits. Density tracer techniques have been developed to estimate the differences in separation density between circuits and hence allow compensatory adjustment of circulating medium specific gravities, but even with this more sophisticated approach, separation density differences of up to 0.02 relative density units have still been measured. Furthermore, on-site labour restrictions invariably limit the frequency with which the tracer tests can be conducted to a maximum of once per week. Even at this frequency, significant differences have been found in the results of successive tests.

In Australian patent 554,917 Curtis L Burgess discloses a method of continually measuring separation density. The method is based on the recognition that the separation density in a dense-medium cyclone is a function of the distribution of the magnetite between the underflow and the overflow streams from the cyclone. Whilst the method proposed by Burgess is an improvement over the non-continuous techniques disclosed in the preceding paragraph, the Burgess method has several disadvantages. In this regard, in order to carry out the Burgess method it is necessary to measure flow rate and percent magnetics in both the overflow and the underflow, and this is a disadvantage in terms of the number of separate measurements and subsequent data processing steps required and also in terms of the accuracy of the end result, since errors of measurement of the underflow flow rate introduce a relatively high error factor into the calculations.

An object of the present invention is to provide a method of beneficiating coal which alleviates the disadvantages described in the preceding paragraphs.

According to the present invention there is provided a method of beneficiating coal containing refuse material, the refuse material having a different density than the coal, in a dense-medium cyclone comprising:

(a) introducing a dense media comprising a slurry of magnetite and water in the cyclone to effect a separation at a separation density within predetermined limits;

(b) introducing coal containing refuse material into the cyclone;

(c) withdrawing beneficiated coal and the media from an overflow of the cyclone;

(d) withdrawing refuse material and the media from an underflow of the cyclone; and (e) maintaining the separation density within the said predetermined limits by measuring the total solids content in the overflow and comparing this with a predetermined correlation with separation density and by changing the relative proportions of the feed flow of magnetite and/or water to said cyclone when the separation density as determined by the correlation is outside the said predetermined limits.

According to the present invention there is also provided a method of maintaining the separation density of a dense media comprising a slurry of magnetite and water within predetermined limits in a dense- medium cyclone for beneficiating coal containing refuse material, the refuse material having a different density than the coal, the method comprising:

(a) measuring the total solids content in an overflow of the cyclone;

(b) comparing the total solids content with a predetermined correlation with separation density; and (c) changing the relative proportions of the feed flow of magnetite and or water to said cyclone when the separation density as determined by the correlation is outside the said predetermined limits.

The present invention is based on the realisation that the total solids, i.e. the magnetics and the non-magnetics, in the overflow has a more sensitive relationship to the separation density than the magnetic split relationship between the overflow and the underflow streams disclosed in the Burgess patent.

Figure 2:
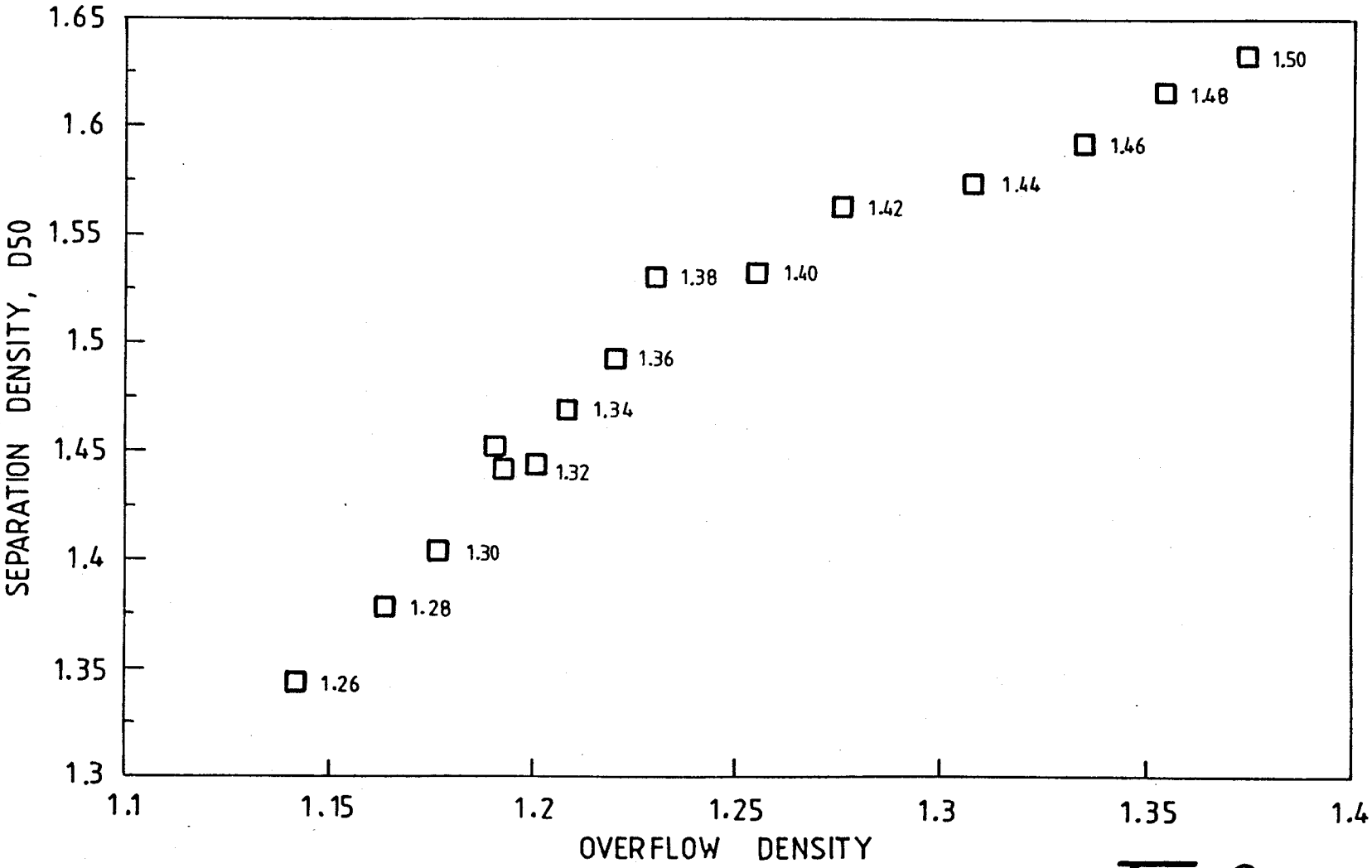

The present invention is described further by way of example with reference to the accompanying drawings, in which:

FIG. 1 is a schematic diagram of a preferred embodiment of a dense-medium cyclone circuit incorporating means for maintaining the separation density within predetermined limits in accordance with the present invention; and FIG. 2 is a graph illustrating the relationship between separation density and the density of total solids in the overflow stream of the dense-medium cyclone circuit shown in FIG. 1.

In the dense-medium cyclone circuit shown in FIG. 1 coal containing refuse material is directed through inlet line 3 into a dense-medium cyclone or group of dense medium cyclones 5 arranged in parallel containing a dense media comprising a slurry of magnetite and water. The dense media is selected to provide a separation density within predetermined limits which are optimum for the coal type and operating parameters of the cyclone 3 so that the coal reports to an overflow line 7 and the refuse reports to an underflow line 9.

Both the overflow and underflow streams contain magnetite and therefore it is necessary to add magnetite and water to the cyclone 5 through a magnetite make-up line 11, controlled by a valve 13, and a water make-up line 15, controlled by a valve 17.

In order to ensure optimum operation of the dense-medium cyclone circuit it is important to control the separation density of the dense-media within the predetermined limits. Moreover, in situations where a number of the dense-medium cyclone circuits are connected in parallel, which invariably is the case to beneficiate large tonnages of coal, it is important to control the separation density of the dense media equal in each dense-medium cyclone circuit receiving the same coal feed.

The present invention is based on the realisation that the separation density of the dense media is a function of the density of the total solids, i.e. magnetics and non-magnetics, in the overflow stream. This relationship between separation density and overflow density is shown by way of example in FIG. 2.

The relationship shown in FIG. 2 was established from data obtained during the course of experimental work carried out on module 50 of the B Plant washery at BHP Slab and Plate Products Division at Port Kembla, N.S.W. The experimental work was carried out on Bulli seam coals from the Appin and Cordeaux mines and on Wongawilli seam coal from the Kemira mine fed through the module at feed rates of 12, 24, 32, 44 and 57 tonnes per hour.

The relationship shown in FIG. 2 establishes that by measuring the overflow density at any given time it is possible to determine accurately the separation density of the dense media in the cyclone 5 and to make adjustments to the magnetite and/or water feed rates to the cyclone, as required, to maintain the separation density within the predetermined limits (and equal in each dense-medium cyclone circuit in a parallel installation).

With reference to FIG. 1, the overflow density is measured by a density gauge 19, which may be of any suitable type such as a differential pressure gauge, and the measurements are transferred to a controller 21, which may be of any suitable type, for processing. Specifically, the controller 21 monitors the separation density of the dense media, as determined from the correlation shown in FIG. 2, and if the separation density is outside the predetermined limits the controller actuates valves 13, 17 as required to adjust the magnetite and/or water flow rates into the cyclone 5 to return the separation density of the dense media to within the predetermined limits.

In a situation where there are a number of the dense-medium cyclone circuits connected in parallel it is envisaged that the measurements from each cyclone 5 would be transferred to a single controller 21 for processing and the controller 21 would actuate the valves 13, 17, as required, to maintain the separation density equal in each cyclone 5.

Many modifications may be made to the preferred embodiment of the invention described above without departing from the spirit and scope of the present invention.

We claim:

1. A method of beneficiating coal containing refuse material, the refuse material having a different density than the coal, in a dense-medium cyclone comprising:
   (a) introducing a dense media comprising a slurry of magnetite and water in the cyclone to effect a separation at a separation density within predetermined limits;
   (b) introducing coal containing refuse material into the cyclone;
   (c) withdrawing beneficiated coal and the media from an overflow of the cyclone;
   (d) withdrawing refuse material and the media from an underflow of the cyclone; and
   (e) maintaining the separation density within the said predetermined limits by measuring the total solids content in the overflow and comparing this with a predetermined correlation with separation density and by changing the relative proportions of the feed flow of magnetite and/or water to said cyclone when the separation density as determined by the correlation is outside the said predetermined limits.

2. The method defined in claim 1, wherein the measurement of total solids content in the overflow as part of step (e) comprises measuring the density of solids in the overflow.

3. The method defined in claim 1 further comprising recovering magnetite from the overflow and/or the underflow and recycling the magnetite for use in the cyclone.

4. A method of maintaining the separation density of a dense media comprising a slurry of magnetite and water within predetermined limits in a dense- medium cyclone for beneficiating coal containing refuse material, the refuse material having a different density than the coal, the method comprising:
   (a) measuring the total solids content in an overflow of the cyclone;
   (b) comparing the total solids content with a predetermined correlation with separation density; and
   (c) changing the relative proportions of the feed flow of magnetite and or water to said cyclone when the separation density as determined by the correlation is outside the said predetermined limits.

5. The method defined in claim 4, wherein step (a) comprises measuring the density of total solids in the overflow.

6. The method defined in claim 4 wherein step (c) comprises recovering magnetite from the overflow and an underflow of the cyclone and recycling the magnetite to the cyclone.

* * * * *